United States Patent [19]

Bozzano

[11] 4,008,679

[45] Feb. 22, 1977

[54] MOTORBOAT PROVIDED WITH POWER OPERATED RETRACTABLE WHEELS FOR LANDING ON BEACHES

[76] Inventor: Stefano Bozzano, 38/8 Via Perniciaro, Mele (Genoa), Italy

[22] Filed: May 27, 1975

[21] Appl. No.: 580,785

[30] Foreign Application Priority Data

June 3, 1974 Italy ..... 12827/74

[52] U.S. Cl. ..... 115/1 A; 9/1.2

[51] Int. Cl.[2] ..... B60F 3/00

[58] Field of Search ..... 115/1 R, 1 A; 280/414 A; 244/102 R; 9/1.2

[56] References Cited

UNITED STATES PATENTS 3,393,883 7/1968 Smith et al. ..... 244/102 R

*Primary Examiner*—Trygve M. Blix

*Assistant Examiner*—Sherman D. Basinger

[57] ABSTRACT

The hull of the motorboat is provided on its bottom with three recesses disposed in a tricycle arrangement, each housing a retractable landing wheel. At least one of the wheels is powered by a suitable fluid operated motor. Shutters are provided operatively associated with the retractable wheel, to close the wheel housing recesses each time the respective wheel is retracted in the recess, thus re-establishing the continuity of the hull bottom.

1 Claim, 5 Drawing Figures

MOTORBOAT PROVIDED WITH POWER OPERATED RETRACTABLE WHEELS FOR LANDING ON BEACHES

BACKGROUND AND SUMMARY OF THE INVENTION

This invention relates to a motorboat provided with power operated retractable wheels for landing on beaches. According to one aspect of the invention, the hull of the boat is provided on its bottom with three recesses disposed in a tricycle arrangement, each housing a retractable landing wheel, shutter means being provided operatively associated with the retractable wheels, to close the wheel housing recesses each time the wheels are retracted in the recesses, in order to re-establishing the continuity of the hull bottom.

According to a further aspect of the invention, at least one of the wheels is powered by a suitable fluid operated motor.

Advantageously, the powered wheel is in the form of a tracked wheel.

According to a still further aspect of the invention, means are provided associated with at least one of the wheels for steering.

BRIEF DESCRIPTION OF THE DRAWINGS

Further objects and advantages of the invention will become apparent from the following description, made with reference to the accompanying drawings, in which.

DESCRIPTION OF THE PREFERRED EMBODIMENTS OF THE INVENTION

Figure 1:
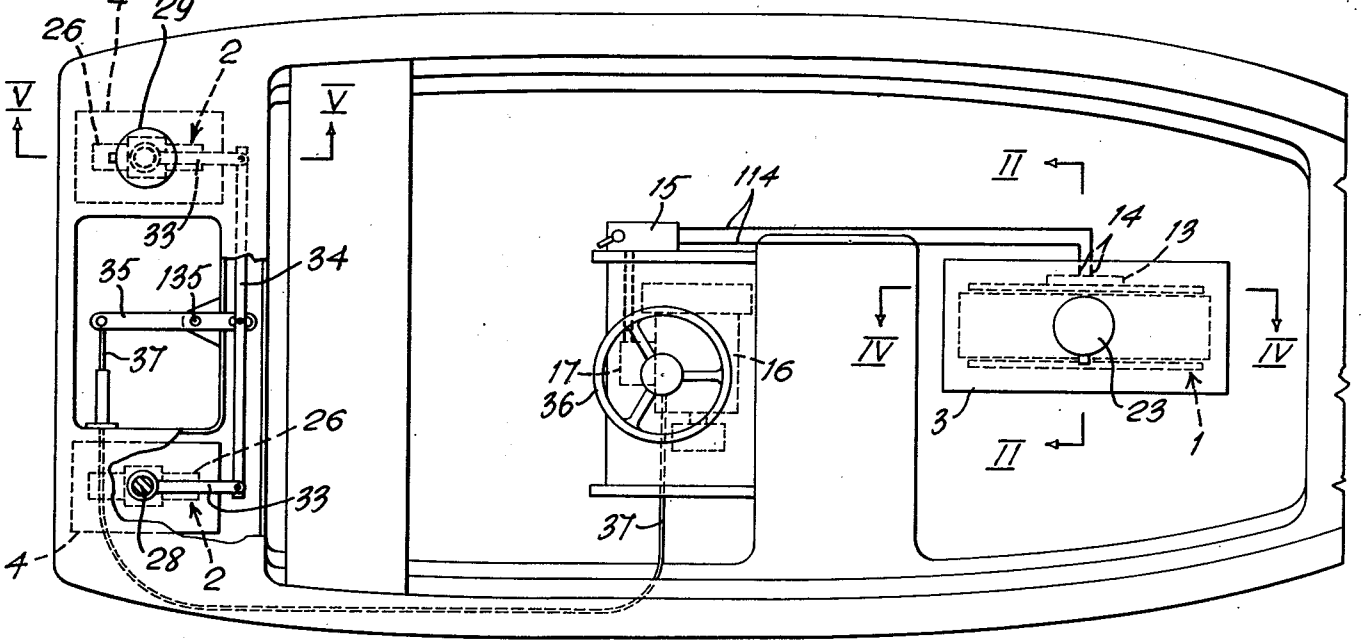
FIG. 1 is a top plan view of a motorboat provided with the retractable landing wheels according to the invention.

With reference to the drawings, the boat shown comprises a hull 5, provided on its bottom with one recess 3, formed centrally of the boat hull, in the bow region of the hull, and with two recesses 4 formed along the sides in the stern region of the hull. In the recesses 3 and 4 the landing gears 1 and 2 are housed.

Figure 2:
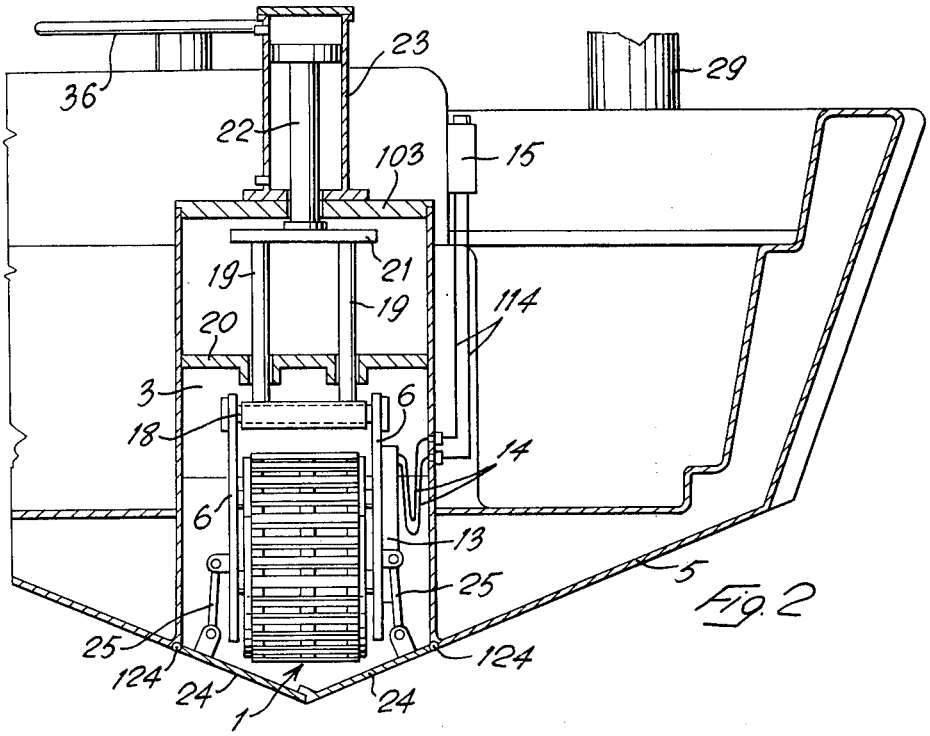
FIG. 2 is a transversal section of the boat of FIG. 1, taken along line II—II of FIG. 1, with the landing wheels in retracted position.
Figure 3:
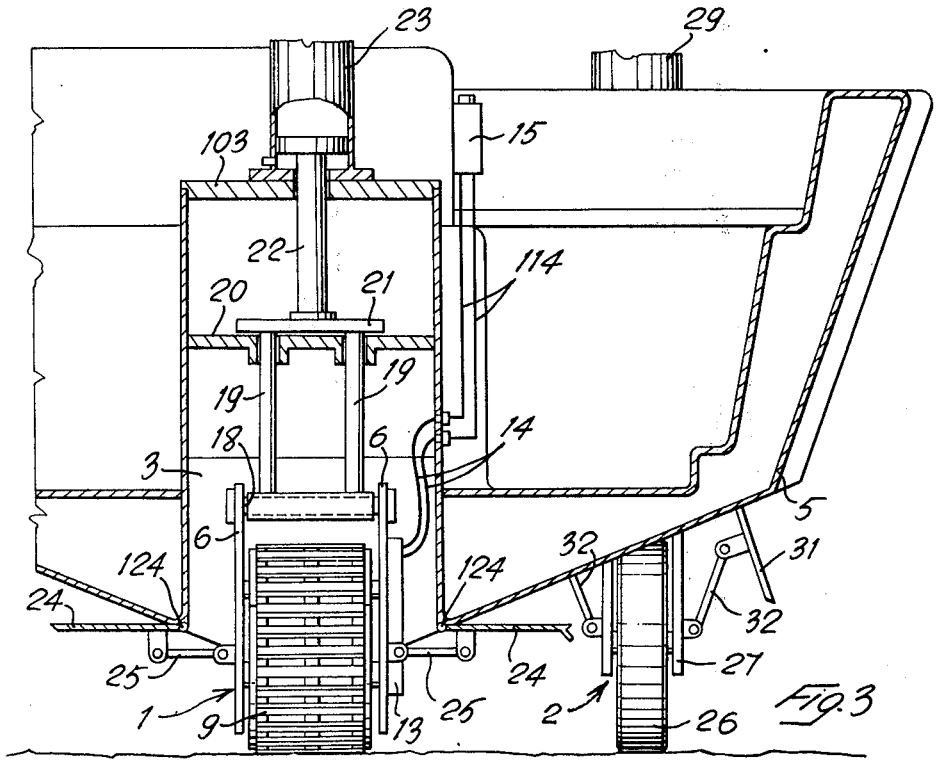
FIG. 3 is a transverse section corresponding to FIG. 2, with the landing wheels extended in landing position.
Figure 4:
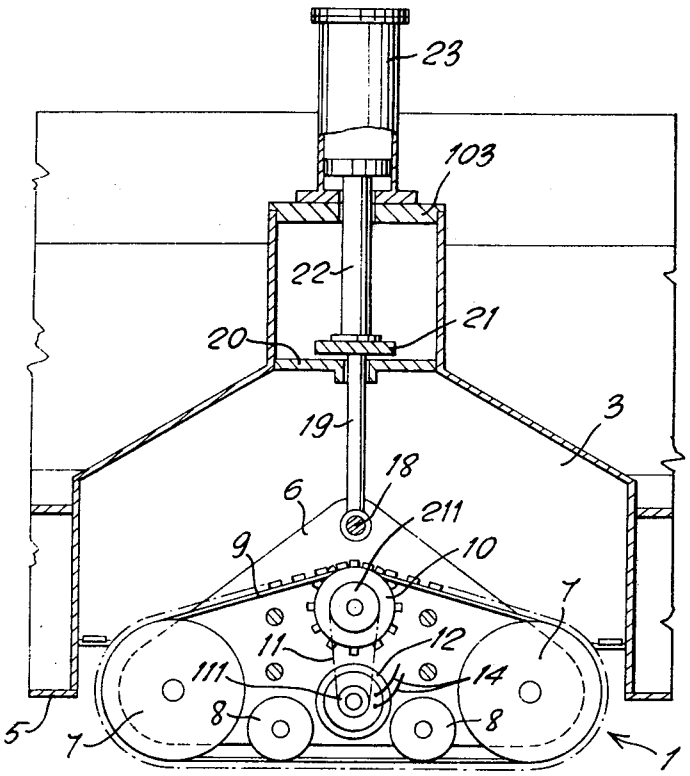
FIG. 4 is a longitudinal sectional view taken along line IV—IV of FIG. 1, showing a motor powered bow landing track in extended position.

With reference to FIGS. 2 to 4, the bow landing gear 1 comprises two substantially triangular side plates 6, between which two track wheels 7 are rotatably supported. An endless track 9, is guided around the front and rear wheels 7. The track 9 is made to revolve by engaging the teeth of a toothed wheel 10. The wheel 10 is keyed on a shaft, on which the chain wheel 211 is keyed, forming part of a power transmission comprising the transmission chain 11 and the chain wheel 111 keyed on the output shaft of a hydraulic motor 12. The hydraulic motor 12 is connected via the flexible hose 14 to the fluid supply line 114 which in turn is connected, through the inverter 15, to the fluid pump 16.

The transmission from motor 12 to wheel 10 is housed inside of casing 13.

The lower run of the track 9 is supported in its intermediate region by the idle rollers 8.

The said track wheel structure 1 is hingedly connected through stud 18 to one end of the two rods 19 slidably guided through two guide bushings formed in the intermediate plate 20, connected at their other end to a plate 21 which is secured to the rod 22 of a piston slidable in the double effect cylinder 23. The cylinder 23 is supported by the plate 103, and is connected to a pressure fluid supply line (not shown).

At both sides of the opening of the recess 3, the two shutters 24 are hingedly connected. The shutters 24 are further connected in an articulated manner through tie rods 25 to the side plates 6 of the track structure.

Figure 5:
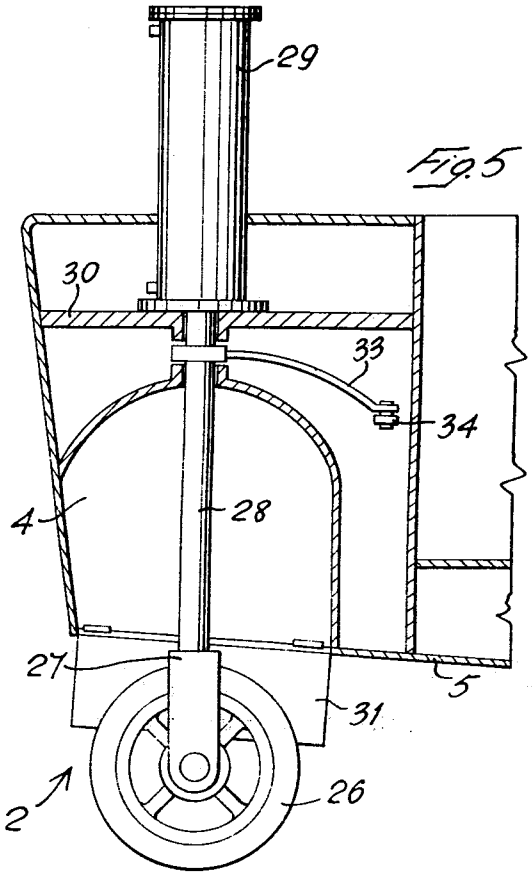
FIG. 5 is a longitudinal sectional view taken along line V—V of FIG. 1 showing one of two steerable stern landing wheels in extended position.

With reference to FIG. 5, each stern landing gear 2 comprises a wheel 26 rotatably supported by the fork 27, which in turn is secured to the piston rod 28 connected to a piston slidable inside of the double effect cylinder 29. The cylinder 29 bears on a support plate 30, and is connected to a pressure fluid supply line (not shown).

The two piston rods 28 are each connected in a slidable but not rotatable manner to one end of a lever arm 38, pivotably connected at its other end to one end of a rod 24, which is pivotably connected at its central part to one end of a lever arm 35, fulcrumed at 135 to the boat hull structure, and connected at its other end to one end of a flexible cable 37 of a cable transmission, connected at its other end to the steering mechanism of steering wheel 36.

At both sides of the openings of the recesses 4, two shutters 31 are hingedly secured, the said shutters 31 being in turn connected in an articulated manner through tie rods 32 to the forks 27 of the stern landing wheels 26.

OPERATION OF THE DESCRIBED DEVICE

In operation whenever it is desired to extend the landing wheels from their housing recesses, fluid under pressure is admitted into the upper section of the double effect cylinders 23 and 29, thus lowering the piston rods 22 and 28 and the landing gears connected thereto. Concurrently with the lowering of the landing gears 1 and 2, the shutters 24 and 31 are pushed into open position through rods 25 and 32, (position of FIG. 3). As soon as the gear 1 becomes into contact with the beach, the motor 12 is put into operation through pump 16, inverter 15 line 114 and hose 14, thus rotating track 9. In order to stear the boat whilst going on the beach, the steering wheel 36 is rotated. The movement from steering wheel 36 is transmitted through cable 37 to lever 35, thus shifting the rod 34, which rotates the levers 33 and the rods 28 connected thereto, thus rotating the landing wheels 26.

It will be evident that by admitting fluid pressure to the lower section of the double effect cylinders 23 and 29, the gears 1 and 2 are retracted inside of the recesses 3 and 4, with concurrent closure of the opening of said recesses through the shutters 31 and 24.

I claim:

1. A motorboat provided with power operated retractable wheels for landing on beaches comprising a hull provided on its bottom with a triangular array of three recesses, one of said recesses being located at the bow end of said boat, and the other recesses being aligned with each other at the stern end of said boat, an extendable and retractable landing gear mounted in each recess, an endless track wheel mounted on the landing gear in the bow recess and fixed to rotate in a plane parallel to the keel of said boat, means for driving said track wheel to propel said boat on the ground, first hydraulic means for extending and retracting said landing gear in said bow recess, a wheel mounted on each of the landing gears in the stern recesses to pivot steerably about a vertical axis, second hydraulic means for extending and retracting said landing gears in said stern recesses, and steering means interconnecting the wheels in said stern recesses for conjoint pivoting, and shutter means pivotally mounted adjacent each recess and being adapted to span said recess, and articulated link means operatively interconnecting said shutter means with the associated landing gears in the respective recesses to conjointly open and close said recesses each time said landing gears are extended from and retracted into their recesses.

* * * * *